US005167678A

United States Patent [19]

Elonen et al.

[11] Patent Number: 5,167,678

[45] Date of Patent: Dec. 1, 1992

[54] APPARATUS FOR SEPARATING GAS WITH A PUMP FROM A MEDIUM BEING PUMPED

[75] Inventors: Jorma Elonen, Jämsaänkoski; Jukka Timperi, Kotka; Reijo Vesala, Kotka; Vesa Vikman, Kymi, all of Finland

[73] Assignee: A. Ahlstrom Corporation, 29600 Noormarkku, Finland

[21] Appl. No.: 686,121

[22] Filed: Apr. 15, 1991

Related U.S. Application Data

[63] Continuation-in-part of Ser. No. 336,208, Apr. 11, 1989, Pat. No. 5,019,136.

[30] Foreign Application Priority Data

Apr. 11, 1988 [FI] Finland ..... 881660

[51] Int. Cl.[5] ..... B01D 19/00

[52] U.S. Cl. ..... 55/203; 415/169.1

[58] Field of Search ..... 55/36, 203; 415/168.1, 415/169.1, 181

[56] References Cited

U.S. PATENT DOCUMENTS

| | | | |
|---|---|---|---|
| 4,776,758 | 10/1988 | Gullichsen | 415/169.1 |
| 4,877,424 | 10/1989 | Perkola et al. | 55/203 |
| 4,900,335 | 2/1990 | Algers | 55/203 |
| 4,921,400 | 5/1990 | Niskanen | 415/169.1 |
| 4,936,744 | 6/1990 | Dosch et al. | 415/169.1 |
| 4,971,519 | 11/1990 | Timperi et al. | 55/203 |
| 4,981,413 | 1/1991 | Elonen et al. | 415/169.1 |
| 5,019,136 | 5/1991 | Elonen et al. | 55/203 |
| 5,039,320 | 8/1991 | Hoglund et al. | 55/203 |

*Primary Examiner*—Bernard Nozick

*Attorney, Agent, or Firm*—Cohen, Pontani, Lieberman & Pavane

[57] ABSTRACT

A pump for pumping an air containing medium includes rear vanes (11) on the propeller back plate of the pump and a back ball arranged so that a radially widening space is created between the impeller back plate and the rear wall for guiding the flow of the medium, generated by the combined effect of forces with different directions and different intensities directed at the medium in the spaces between the rear vanes, past gas discharge opening (12) in the rear wall of the pump or for retarding the flow thereby preventing the flow from entering the gas discharge opening (12).

33 Claims, 10 Drawing Sheets

APPARATUS FOR SEPARATING GAS WITH A PUMP FROM A MEDIUM BEING PUMPED

RELATED APPLICATIONS

This is a continuation-in-part of U.S. application Ser. No. 07/336,208, filed Nov. 4, 1989 now U.S. Pat. No. 5,019,136.

FIELD OF THE INVENTION

The present invention relates to a method and apparatus for separating gas with a pump from a medium being pumped. More precisely, the apparatus relates to the gas discharge arrangement of a pump used in the pumping of a gas containing medium. The pump in accordance with the present invention is especially suitable for pumping low, medium and high consistency fiber suspensions of the pulp and paper industry.

BACKGROUND OF THE INVENTION

It is already known that pumping of liquids having a high gas content may not be carried out without simultaneous gas discharge, because the gas will separate and accumulate around the center of the rotor of the pump and form a bubble which tends to grow and eventually will fill the entire inlet opening of the pump. This results in a considerable decrease of efficiency and will cause vibration of the equipment and in the worst case leads to the interruption of the pumping action all together. This problem appears to be especially severe in centrifugal pumps which have been used for decades, for example, for pumping low consistency fiber suspensions in the wood processing industry. Various attempts have been made to solve these problems by discharging the gas bubble from the pump. Today gas is discharged in known and used apparatus either by drawing gas with suction through a pipe which extends into the hub of the impeller located in the center of the suction opening of the pump, or by drawing the gas through the hollow shaft of the impeller, or by arranging at least one hole in the impeller through which the gas is drawn toward the back side of the impeller and further away therefrom.

All the apparatus operate satisfactorily when the medium being pumped is liquid and substantially free from solids. Problems arise only when the medium includes solid particles, such as fibers, threads, etc. In such cases these particles prevent the ducts from remaining clear and open, which again is a necessity for the proper operation of the pump.

There are several known ways by which the disadvantage and risk factors caused by these impurities may be eliminated or minimized. The simplest way is to provide a sufficiently large gas discharge duct so that clogging is out of the question. Other alternatives are, for example, the provision of different blade wheel arrangements at the back side of the impeller. Often radial vanes are arranged on the back surface of the impeller, the purpose of which vanes is to pump the medium which has flown with the gas through the gas discharge openings of the impeller to the outer rim or periphery of the impeller and from its clearance back to the liquid flow. The ultimate purpose of the vanes behind the impeller is to balance the axial forces of the pump which is preferably accomplished when the number of back vanes is equal to the number of the pumping vanes. In some cases a separate pumping arrangement is used having the same purpose as above mentioned, but which is mounted further behind the impeller by means of a blade wheel mounted on the shaft of the impeller. This blade wheel rotates in its own chamber thereby separating the liquid flowing with the gas and guiding it to the outer periphery of the chamber so that the gas can be drawn away by suction from the center of the chamber. The medium together with the impurities accumulated at the outer periphery of the chamber is guided via a separate duct either to the suction or to discharge side of the pump. As stated, all disclosed apparatus operate satisfactorily only when a limited amount of impurities is present in the liquid.

It is also possible to adjust the apparatus to operate relatively reliably also with liquids containing a substantial amount of solids, for example, fiber suspensions of the pulp and paper industry. In that case it is, however, necessary to yield in the gas discharge ability of the pump, since it is essential that no or hardly any fibers enter the gas discharge duct or come into contact with the vacuum pump communicating therewith. Thus gaseous fiber suspension present behind the impeller is, as a precaution, generally fed back to the main flow. On the other hand, it is known that the presence of gas in the fiber suspension is a negative factor in the pulp treatment process which should be eliminated as far as possible. It is therefore a waste of existing advantages to feed the once-separated gas back to the pulp circulation. On the other hand, it is also a waste of pulp to separate the pulp flow together with the gas from the pulp circulation by discharging the gaseous pulp as a secondary flow from the pump.

The purpose of the present invention is therefore to utilize the capability of a centrifugal pump most efficiently for separating gas from a liquid by discharging the gas from the pump by simple and operationally safe means. The only precondition is to operate without the risk of impurities present in the liquid, i.e. solids, such as threads, fibers, etc., to clog the gas discharge system.

Pending U.S. Pat. appln. No. 216,009, now U.S. Pat. No. 4,921,400, discloses a method of ensuring that the fibers of the suspension cannot clog the gas discharge system or the vacuum pump communicating therewith even in the case of pumping fiber suspensions of the pulp and paper industry. In that application a filter surface or the like is arranged in the flow passage of the gas being discharged prior to entry thereof into the vacuum pump used in the process. The disclosed filter surface prevents the fibers from entering the gas discharge system.

U.S. Pat. No. 4,673,330 discloses a method of controlling the operation of a centrifugal pump by adjusting the size of the gas bubble generated in front of the pump impeller. The device in accordance with that publication comprises a plurality of electric sensors arranged radially on the rear wall of the pump housing behind the impeller. The sensors measure the size of the gas bubble generated between the impeller and the rear wall on the basis of the varying ability of liquid and gas to conduct electricity.

It is noted in that publication that neither the medium between the vanes of the impeller nor the gas bubble inside the medium are evenly round, but that the boundary surface therebetween is to some extent serrate in such a way that each foil in a way pushes the medium layer in front of it and the medium layer tends to move towards the outer periphery of the pump due to the centrifugal force. However, for some unexplained reason that portion of the medium which is in contact with the front surface of the vane pushing the pulp is closer to the center of the impeller. Such irregularity is present not only at the pumping vanes, but also at the so-called rear or back vanes radially arranged behind the impeller.

SUMMARY OF THE INVENTION

According to the present invention and the fact that the factors causing the wavy form of the boundary surface between the gas and the pulp in the above described patent have been thoroughly investigated by applicants, the dimensions of the back vanes of the impeller and the location thereof, the space between the impeller back plate and the back wall of the pump, as well as the size and location of the gas discharge openings extending through the impeller, the dimensions of the central opening of the rear wall behind the impeller of the pump and the respective dimensions of the above described parts have been defined so as to enable the discharge of gas from a centrifugal pump without the known screen plate arrangement or without the above described electric sensors.

The basic principles of the apparatus in accordance with the present invention are as follows:

- the shortest radial dimension of the gas bubble generated at the back side of the impeller must be larger than the radial distance from the pump axis of the central opening in the rear wall of the pump so as to prevent any movable solid particles from flowing into the gas discharge system;
- the largest radial dimension of the gas bubble on the back side has to be at all operating conditions smaller than the radius of the impeller, so as not to allow the gas to flow back to the medium being pumped;
- the distance of the gas discharge openings in the impeller backplate from the pump axis must be larger than the radial distance of the gas discharge opening in the rear wall from the pump axis, so as not to allow any solid particles possibly flowing with the gas to enter the gas discharge system.

Additionally, due to the uneven shape of the gas bubble as discussed above, the radial dimension of the medium layer must also be taken into consideration. The above described conditions cannot be fulfilled when the medium contacting the front surface of the vane pushing the pulp extends to the gas discharge opening in the rear wall and also when the outermost part of the gas bubble extends at the same time to the outer edge of the impeller. In that case the gas discharge opening in the rear wall has to be as small as possible, the limit being the size of the diameter of the shaft. On the other hand, the diameter of the impeller has to be as large as possible, whereby the dimensions of the remainder of the pump set the limit as a certain easily determinable value. Also considering the different operating conditions of the pump, such as the variety of rotational speeds being used in different conditions and the media having different gas contents, a point will be reached at which the radial dimensions of the gas bubble should be decreased or limited as much as possible.

Swiss Patent No. 571,655 discloses a device in which apertures have been provided adjacent the rear surface of a vane at various radial distances from the shaft of the pump, the diameter of the apertures decreasing outwardly from the shaft. In another apparatus, in the so-called first generation MC-pump, the gas discharge opening for the medium consistency pulp have been arranged as oblong openings (FIG. 2) which are located between the vanes of the impeller extending almost from one vane to the next at a similar radial distance from the shaft of the impeller. Thus, heretofore, the positioning of the gas discharge openings have been more or less coincidental without much theoretical or practical experimental definition.

In accordance with the present invention the dimension and position of the rear plate of the impeller and the rear vanes attached thereto as well as the dimensions of the rear wall of the pump have been optimized and the form of the boundary surface between the gas bubble and the liquid ring surrounding the bubble has been adjusted to such an extent that in practice no or hardly any medium being pumped enters the gas discharge system.

The apparatus in accordance with the present invention is characterized in that the rear vanes of the pump or the pump elements operating therewith are arranged to direct the flow of the medium, generated by the combined effect of forces having diferent directions and different intensities and being directed at the medium in the space between the rear vanes, past the gas discharge opening in the rear wall of the pump or to slow down said flow thereby preventing the flow from entering said gas discharge opening.

The method in accordance with the present invention is characterized in that by guiding the flow of the medium, generated by the combined effects of the radial forces, forces parallel to the periphery of the impeller and inertial forces directed at the medium in the space behind the impeller, past the gas discharge opening or by dampening or retarding the flow of the medium caused by these combined effects, the medium is prevented from entering the gas discharge system.

The following presents a non-exhaustive list of advantages of the centrifugal pump in accordance with the present invention:

- more effective discharge of gas from the pump, because it is unnecessary to return gaseous liquid to the main circulation;
- in the pumping of the fiber suspension there is no risk of clogging the gas discharge openings or of the pulp being wasted;
- the construction of the apparatus is simpler, the use thereof more reliable, and the running costs are reduced, because a vacuum pump does not necessarily require a separate driving motor; and
- it becomes possible to pump pulps with considerably higher consistencies, the pumping of which has been heretofore prevented by the high content of air present in high consistency pulps.

The method and apparatus in accordance with the present invention can be utilized not only in conventional centrifugal pumps, whereby it is, of course, necessary to decrease the consistency of the pulp being pumped, but also in prior art MC-pumps which are preferably provided with rotors extending into the suction opening for treating considerably thicker pulps than heretofore possible.

BRIEF DESCRIPTION OF THE DRAWINGS

The apparatus and method in accordance with the present invention are described below, by way of example, with reference to the accompanying drawings, in which.

DESCRIPTION OF THE PRESENTLY PREFERRED EMBODIMENTS

Figure 1:
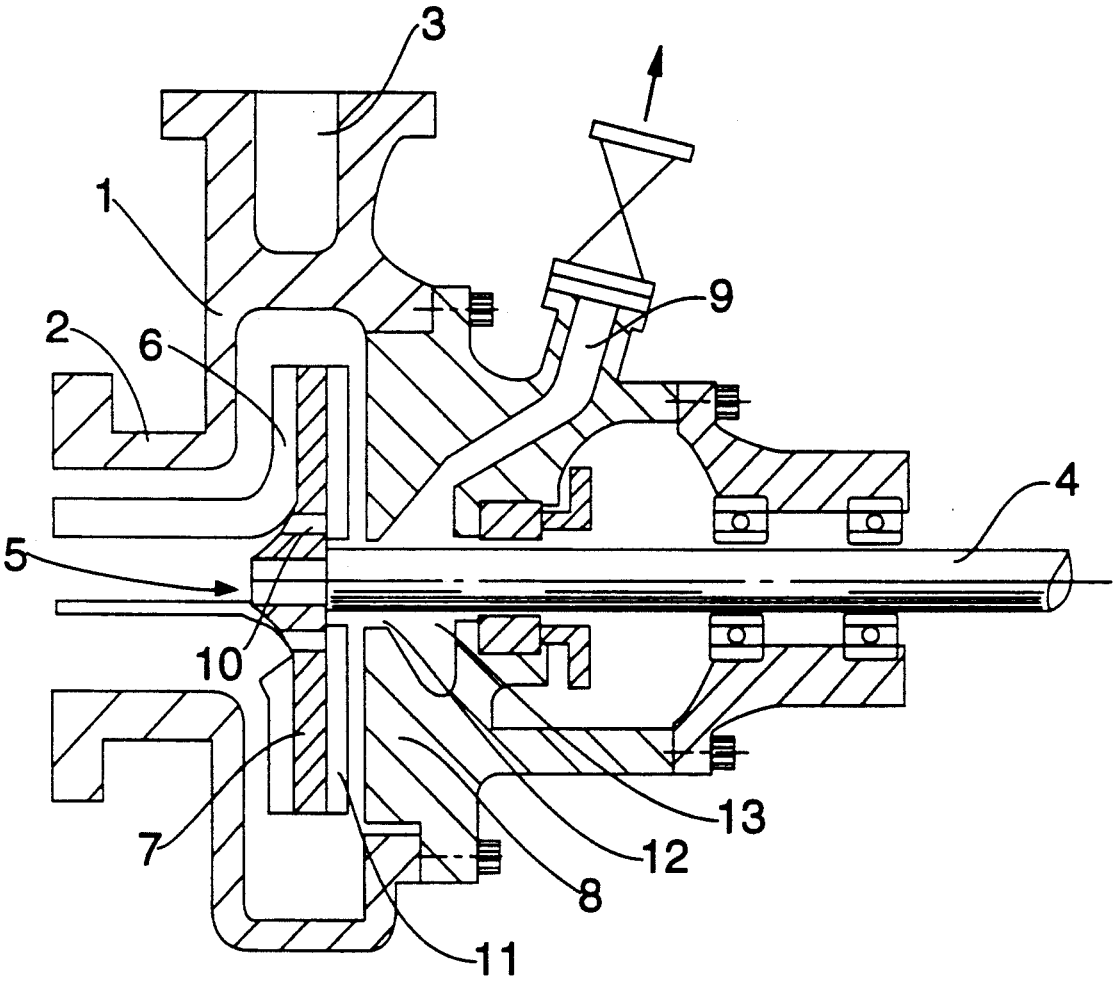
FIG. 1 is a sectional side view of a prior art centrifugal pump and gas discharge system.
Figure 8A:
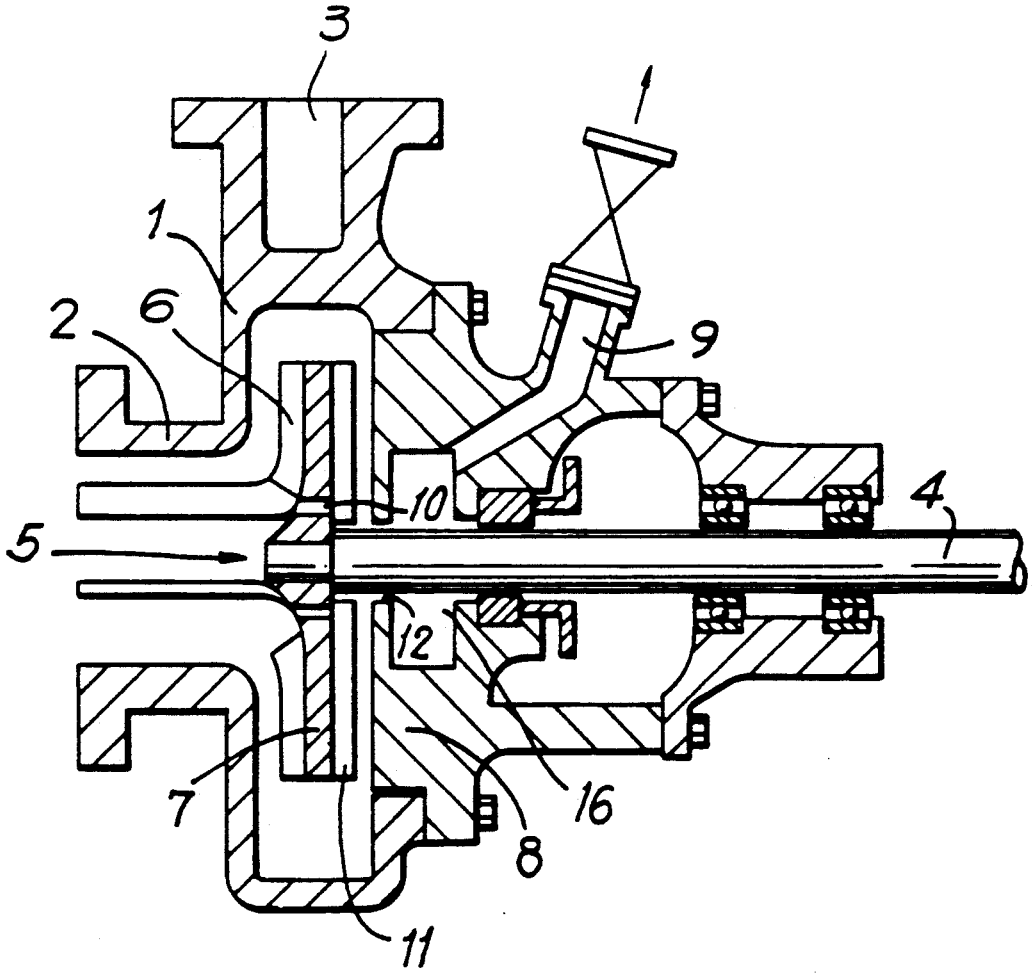
FIGS. 8*a* and 8*b* are showing the pump of FIG. 1 with a vacuum pump on the shaft and separate vacuum pump and drive unit, respectively.
Figure 8B:
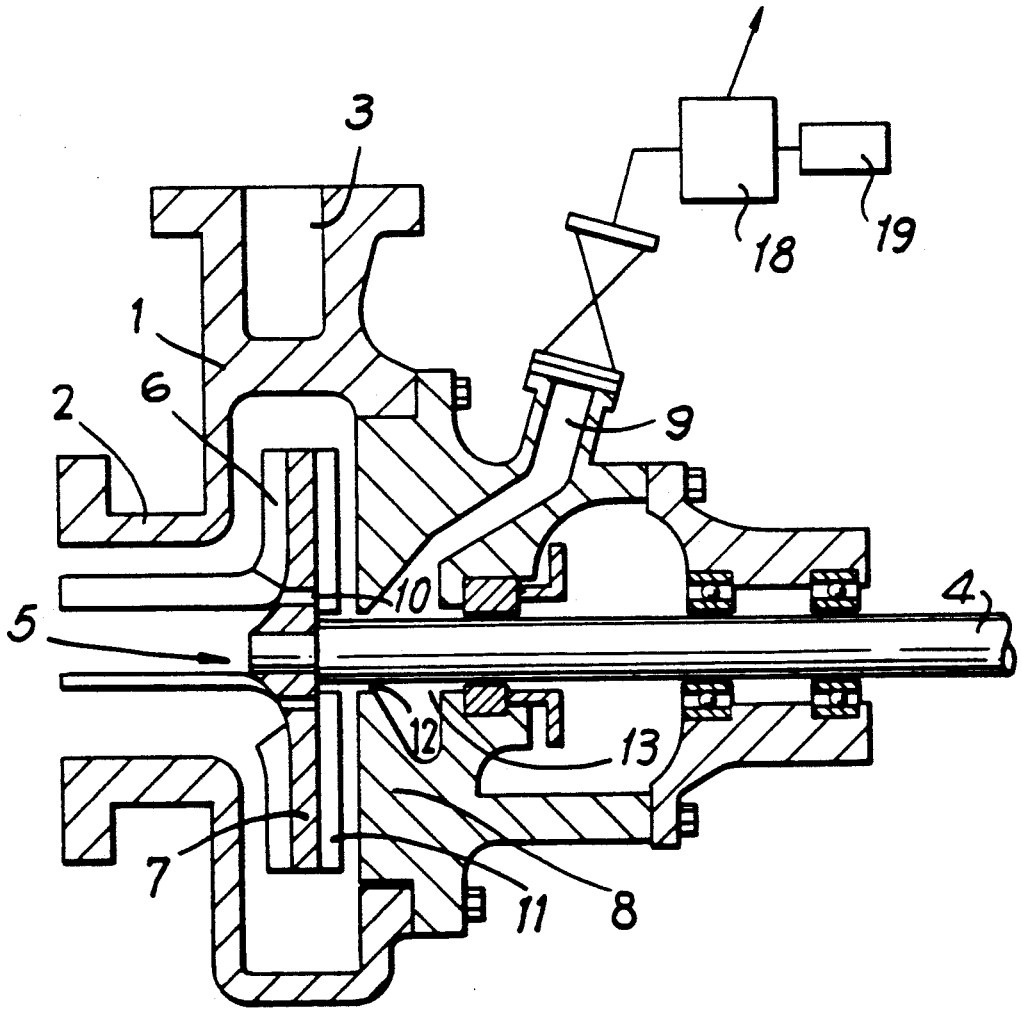

The so-called first generation centrifugal pump for medium consistency fiber suspension (so-called MC-pump) in accordance with FIG. 1, which is described in more detail, for example, in U.S. Pat. No. 4,410,337, mainly comprises a pump housing 1, a suction opening 2, a discharge opening 3, a shaft 4, an impeller 5 provided with pumping vanes 6 extending into the pump opening and mounted for rotation on the shaft, a rear plate 7 of the impeller, a rear wall 8 of the pump and a gas discharge conduit 9. Gas discharge openings 10 in impeller 5 shown in the figure are located in close proximity to shaft 4 of the pump, to ensure that no or hardly any fibrous liquid is permitted to enter the gas discharge system. So-called rear vanes 11 have been mounted radially at the back side of the rear plate 7 of the impeller. The rear vanes 11 have two purposes in this type of a pump. On the one hand, they serve to equalize the axial forces of the pump and, on the other hand, they also tend to pump the liquid which has flown behind the rear plate, back to the main flow and towards the pressure opening 3. Corresponding to and cooperating with the impeller openings 10 an annular duct 12 has been provided around the shaft in the rear wall of the pump through which duct the separated gas is discharged into the space 13 on the back side of the rear wall 8, and from which space the gas discharge conduit 9 leads the gas further away from the pump generally assisted by a separate vacuum pump 18 with separate drive unit 19 (FIG. 8*b*).

Figure 2:
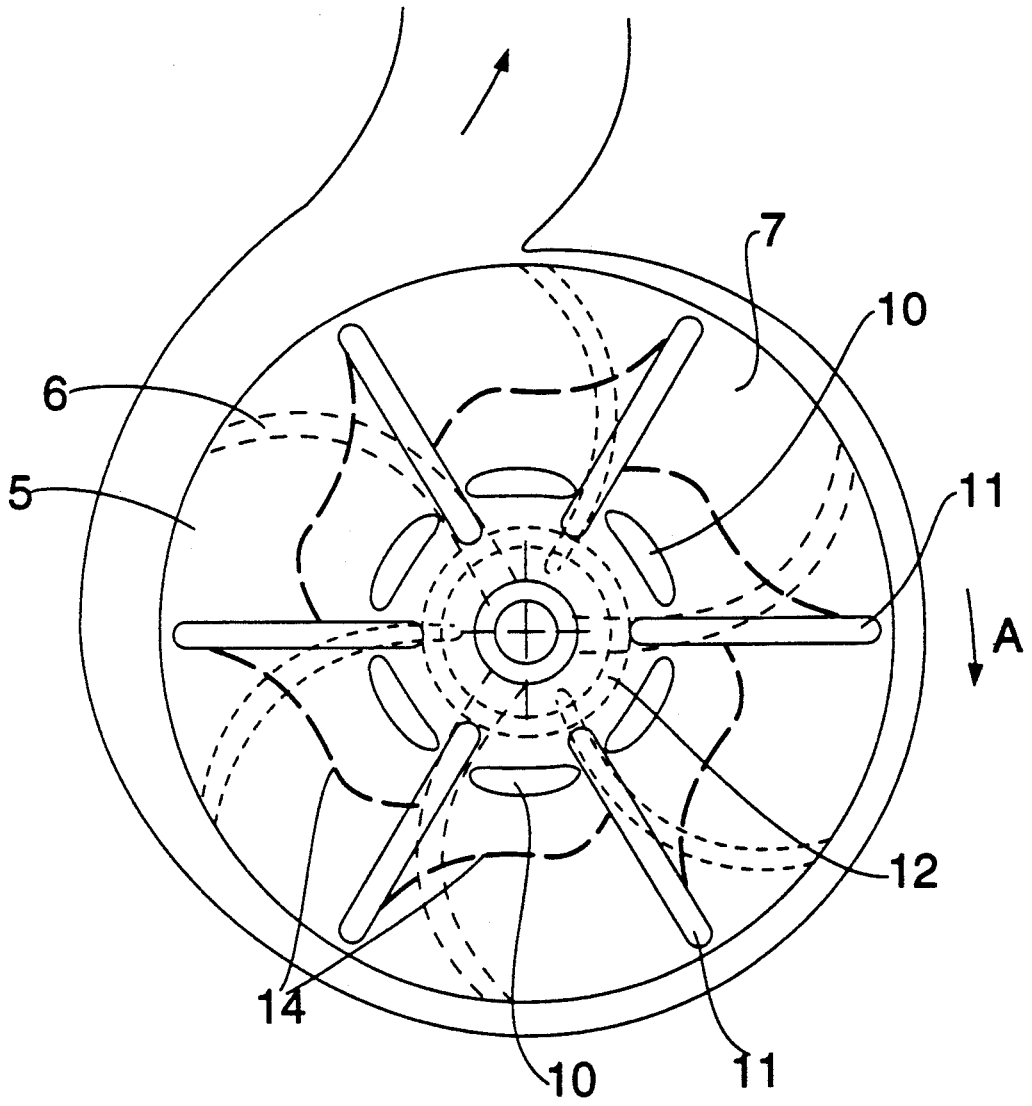
FIG. 2 is a schematic back view of an impeller of a prior art centrifugal pump.

FIG. 2 is a back view of the impeller 5 used in the apparatus disclosed in said U.S. patent. As can be seen, the established number of the so-called rear vanes 11 on the back side of the impeller is 6. Although the aim has been generally to minimize the number of the rear vanes, the number has been settled at 6 because the number of the actual pumping vanes on the opposite side of the impeller is in practice also 6. Furthermore, rear vanes 11 in the prior art apparatus have always been radially arranged so as to simplify the manufacture thereof and because there was no apparent reason for directing them otherwise. The figure also illustrates the construction and location of the gas discharge openings 10, in other words, the openings are oblong and curved substantially parallel to the periphery or outer contour of the impeller and at equal distance from the pump shaft. The figure also illustrates the annular gas discharge duct 12 between the rear wall of the pump and the shaft of the impeller through which the gas will flow into the gas discharge system.

Additionally, an arrow A shows in FIG. 2 the rotational direction of the impeller and the boundary surface between the air bubble on the back side of the impeller and the fiber suspension surrounding it is shown by a broken wavy line 14. The boundary surface has a serrate or wavy shape already described in connection with the known pump. It should also be noted that the shape of the gas discharge openings and the constant radial distance thereof from the pump axis are not most advantageous with respect to the operation of the pump because a corresponding serrate boundary line is also formed at the opposite, the actual pumping side of the impeller. Although the part of the gas discharge openings close to the back side of the pumping vane very efficiently permits the gas to flow from the front side of the impeller to the back side thereof, the other end of each discharge opening easily extends into the fiber suspension zone, whereby some of the fiber suspension will flow to the back side of the impeller which is undesirable. On the other hand, it is noted that the radial dimension of the gas bubble extends closely to the outer edge of the impeller, so if gas is not efficiently enough drawn away from said space, there is a substantial risk that some of the gas will be fed back to the main flow from the outer periphery of the impeller. In such a situation, a compromise must be made regarding the gas dischargeability of the pump, because there is also the risk that, if the suction effect of the vacuum pump is increased, the fiber suspension will be drawn into the gas discharge system through the annular duct 12 between the rear wall of the pump and the shaft whereby the vacuum pump which is generally a liquid ring pump will clog almost immediately requiring both service and possibly also repair.

The essential reasons for the formation of the wavy gas/liquid interface are as follows. When pulp is transferred through the openings of the impeller to the back side thereof, a rotational speed is imparted to the pulp which substantially corresponds to the circumferential speed of the openings. On the back side of the openings, the pulp is subjected to a centrifugal force which tends to throw the pulp outwardly whereby the motional direction of the pulp due to its inertia tends to be, not radial, but curved backwards relative to the movement of the impeller. In other words, the pulp tends to maintain the same circumferential speed it had when discharged from the openings regardless of the fact that the pulp moves constantly outwardly towards the periphery of the impeller, whereby the impeller tends to "pass" the pulp due to the continuously increasing difference in the respective circumferential speeds thereof. The pulp, when moving outwardly during rotation flows against the surface of the rear vane next to the impeller opening, which rear vane accelerates the circumferential speed of the pulp. Because new pulp constantly accumulates along the surface of the rear vane moving outwards and towards the periphery of the impeller, the part of the pulp having the higher circumferential speed will move in the direction of rotation parallel to the periphery and towards the rear surface of the preceding vane, whereby a more or less inclined boundary surface between pulp and gas is formed in the space between the respective vanes. In addition to the circumferential speed and centrifugal force, there is another force affecting the pulp between the vanes, which force is due to the pressure changes caused by the inner contour of the pump housing, for example, a spiral, and which is varying in intensity and is directed towards the shaft of the pump. This force tends to push the pulp towards the shaft of the pump and, more precisely, tends to press the pulp through the central opening in the rear wall of the pump into the gas discharge system. It is known that when the inner contour of the pump housing is a spiral the highest pressure is present essentially at the discharge opening of the pump from where the pressure considerably and evenly decreases when viewed counter to the rotational direction of the impeller, and is at the lowest in the part of the housing immediately following the discharge opening when viewed in the rotational direction of the pump impeller.

Figure 3:
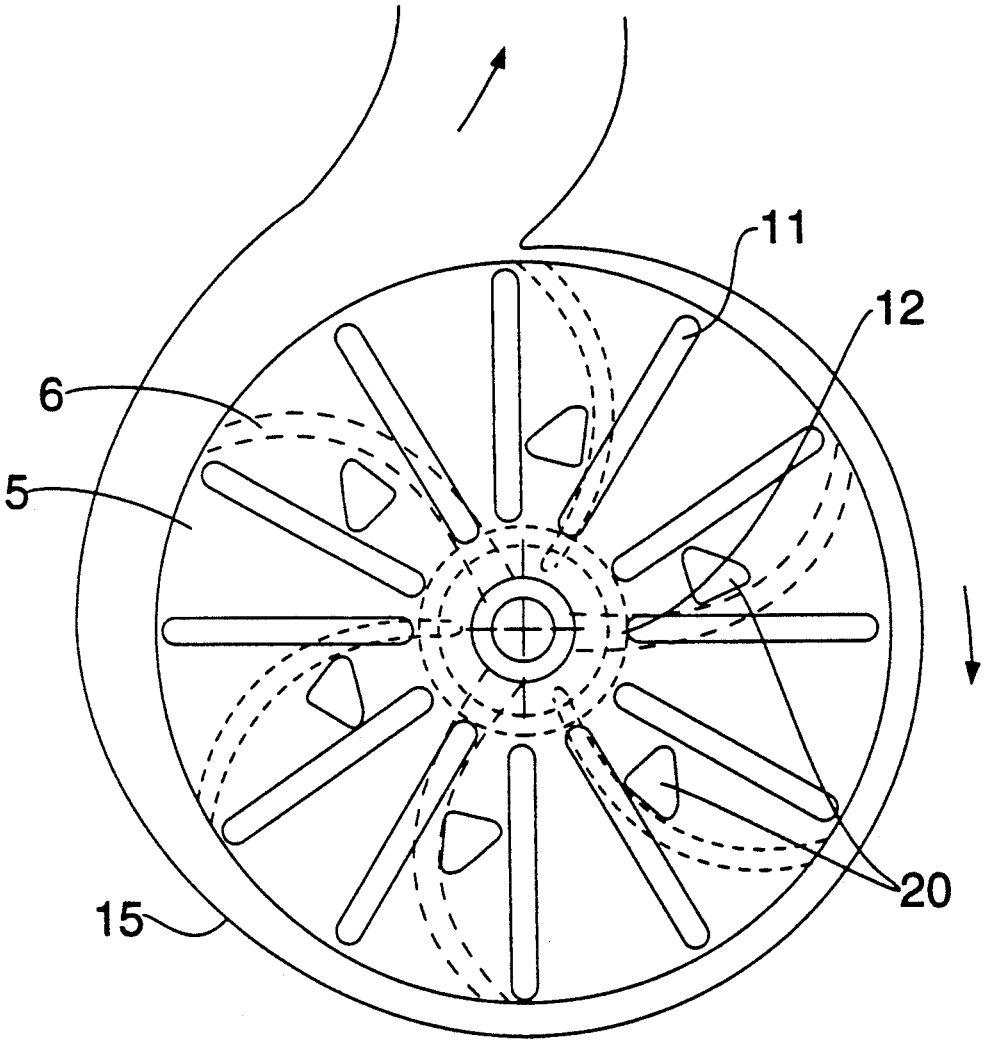
FIG. 3 is a schematic back view of an impeller of a centrigual pump in accordance with an embodiment of the present invention.

FIG. 3 illustrates a back view of an impeller 5 of the pump in accordance with an embodiment of the present invention. As can be seen in that figure, the number of vanes 11 have been increased for rendering the serrate or wavy shape of the boundary surface between the gas bubble and the fiber suspension considerably more even. Due to the addition of rear vanes the peaks of the wavy interface have been cut off in both directions. Due to the higher number of rear vanes 11, the centrifugal force together with the inertial force do not spread the boundary surface between the fiber suspension and the gas bubble radially to a very large area. When the radial force due to the pressure changes caused by the inner contour of the pump housing 15 and their effects are also taken into account, it will be seen that by increasing the number of rear vanes 11 the sectors therebetween become narrower and the effective time a pressure peak has on the pulp in one separate sector will decrease and, provided, the presence of a sufficient number of sectors, an intensive pressure stroke has insufficient time to accelerate the kinetic speed of the pulp towards the shaft to an extent high enough that the pulp would flow to the gas discharge opening 12 in the rear wall 8 of the pump. When the impeller 5 continues to rotate forwards, said sector will reach the low pressure zone whereby the centrifugal force tends to move the pulp back towards the outer periphery of the impeller.

Thus, the use of a greater number of rear vanes alone ensures that the gas does not easily flow back to the main flow of the suspension, although a modest underpressure might be additionally used in the gas discharge system. On the other hand, the use of a greater underpressure can not generate the flow of liquid from the front side of the impeller of the pump through the gas discharge opening to the back side of the impeller or, correspondingly, from the back side of the impeller, to the gas discharge system. It is, of course, possible in practice to use such high underpressure that fibers will enter the gas discharge system, but this would require a considerably over-dimensioned underpressure device to be used with the apparatus in accordance with the present invention. One of the real advantages of the invention is that a pump provided with an impeller in accordance with the present invention operates more reliably in changing operating conditions, because the boundary surface between the gas bubble and the liquid ring is at each point farther from both the outer edge of the impeller and the gas discharge opening or the central opening in the rear wall of the pump. Thus, the present invention permits a considerable margin for the different risk factors present in a pump and relating to the problem of fiber suspension entering the gas discharge system.

Furthermore, the operation of the gas discharge system of the pump may be further facilitated by correctly positioning the gas discharge openings 20 in impeller 5. Most advantageously a gas discharge opening 20 is located in the space between each vane on the pumping side of impeller 5 or at each space between the lines drawn from the inner edge of each pumping vane 6 (shown with broken lines) to the axial line of impeller 5. As mentioned above, the oblong gas discharge openings 10 (FIG. 2) of the prior art MC-pumps do not have the desired shape for the reasons discussed above, and neither is the prior art opening advantageously located. Openings 20 are most preferably located and shaped so that the edge of the opening facing the boundary surface between the gas bubble and the liquid ring follows the shape of the boundary surface 14 (FIG. 2) but is nevertheless located as far away from said boundary surface as possible. Accordingly, FIG. 3 shows gas discharge openings 20 which are substantially triangular and are located in this case at the suction side of every other rear vane 11, in other words, relative to the rotational direction of the impeller at the back side of every second vane 11.

The figure illustrates two rear vanes 11 for each pumping vane 6 of the impeller 5 located in such a way that every other rear vane 11 is located at least partly at the pumping vane 6. If the gas discharge openings 20 have the form shown in FIG. 3 and are located at the position shown in the figure, it is possible to change the position of the gas discharge openings 20 slightly further towards the periphery of the impeller 5 so as to gain more safety margin between the radial distance of the central opening 12 of the rear wall 8 of the pump and the gas discharge openings 20. However, it must be borne in mind that the described triangular form is only a preferred embodiment and that it is, for example, possible to provide openings in round form or openings that are formed by several substantially round perforations.

Figure 4:
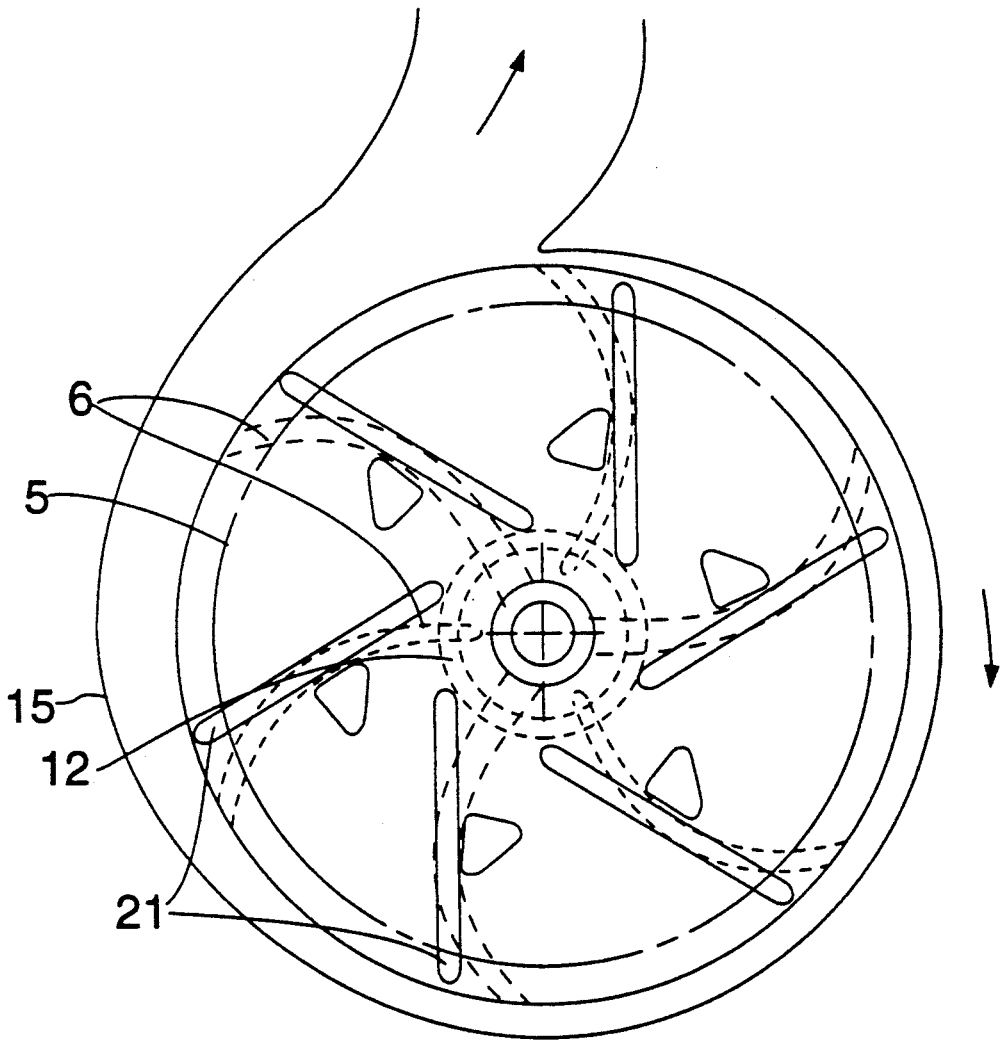
FIG. 4 is a schematic back view of an impeller of a centrifugal pump in accordance with a second embodiment of the present invention.

In another embodiment shown in FIG. 4 the inclination of the rear vanes 21 is changed to increase the pumping action thereof, in other words, vanes 21 are inclined backwards relative to the direction of rotation of the impeller around the point closest to the shaft, whereby the material being pumped is subjected to a motional component directed parallel to the periphery of the impeller and also to a component which will intensify the effect of the radial centrifugal force directed outwardly. It is thus possible to move the boundary surface between the gas bubble and the liquid ring at the surface of rear vane 21 of impeller 5 further up toward the periphery of the impeller thereby further equalizing the shape of the boundary surface. Additionally, the inclination of the vanes increases the distance which the pulp will have to flow during the time the force component caused by the pressure peak of the housing or volute 15 is effective and which is directed towards the shaft thus tending to push the pulp toward the gas discharge duct 12 of the rear wall of the pump. Accordingly, the inclined rear vanes ensure that the pulp has no time to reach the gas discharge opening 12 before the pressure in the volute 15 decreases rapidly to its minimum at which point the centrifugal force becomes rapidly superior to the movement towards the shaft caused by the inertia of the pulp and begins to move the pulp back towards the volute. By using inclined rear vanes 21 it is possible to decrease the number thereof as compared with the previous embodiment, because the same reliability is attained with a smaller number of vanes. On the other hand, it is also possible to tilt the rear vanes to some extent forwards whereby a corresponding combined effect of forces, in other words, the effect of decelerating the flow of the pulp is attained.

Experiments performed by applicants have proven the correctness of the above-described theory, i.e. that by inclining the vanes it is possible to decrease the number thereof and also that an increase of the rotational speed of the impeller will also decrease the number of the vanes required. The vane freqeuncy required with straight radial vanes has been determined in experiments to be about 370 Hz (number of vanes $\times$ rotational speed of the impeller r/s), so as to prevent the pulp flow from entering the gas discharge system.

The number of required inclined vanes is determined by the following formula: $z \times n / \sin \alpha > 370$, in which z is an integer representing the number of vanes, n is the rotational speed of the impeller in r/s, and $\alpha$ is the angle between the average direction of the rear vane and the tangent at the periphery of the impeller. Thus the number of vanes required is: $z > 370 \times \sin \alpha / n$, so, for example, when the angle $\alpha$ is 45° and the rotational speed n is about 50 r/s, the required number of vanes is at least 6, whereas with straight vanes the angle $\alpha$ being 90° the formula results in 8 as the number of required vanes.

Figure 5:
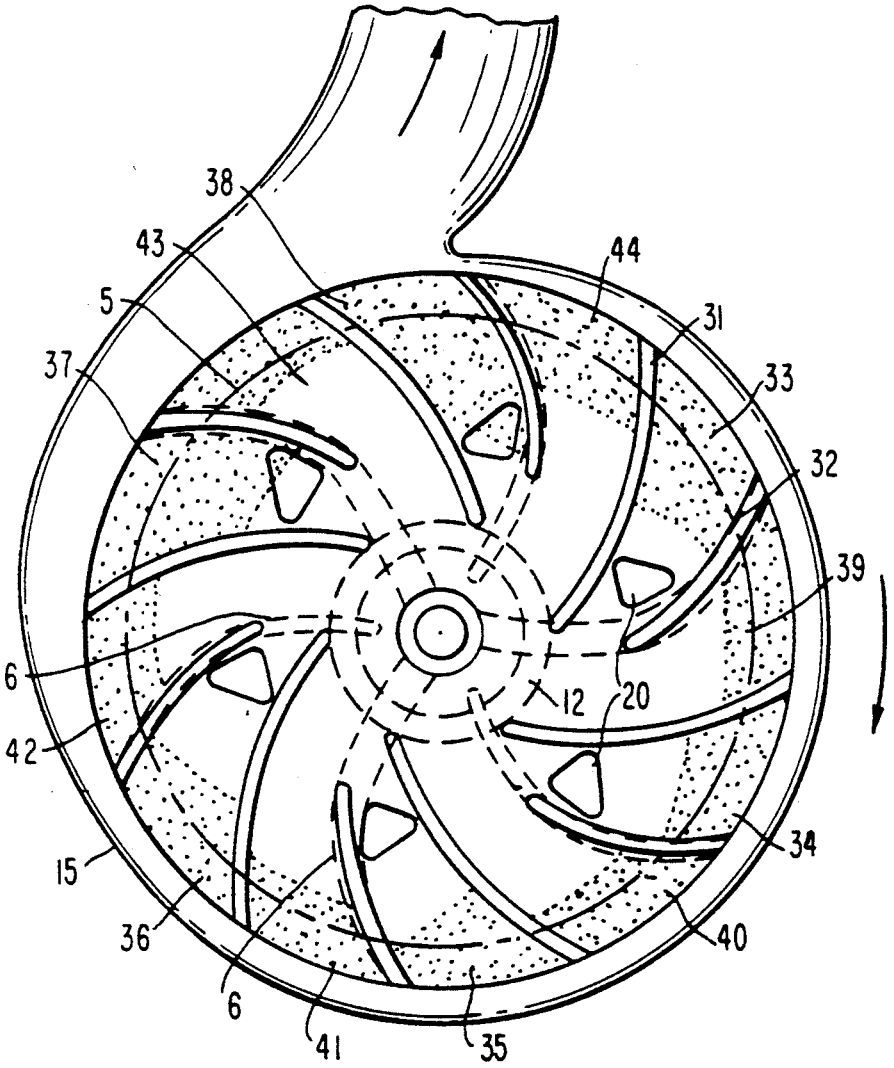
FIG. 5 is a schematic back view of an impeller of the centrifugal pump in accordance with a third embodiment of the present invention.

Yet another embodiment is illustrated in FIG. 5, which shows two rear vanes 31 and 32 for each front vane 6. According to the figure, the rear vanes are all inclined backwards relative to the rotational direction as described in FIG. 4. In addition, the rear vanes are curved and vanes 31 following gas discharge opening 20 in the rotational direction extend substantially the full length from the outer edge of the gas discharge opening 12 in the rear wall of the pump to the outer edge of impeller 5, whereas vanes 32 preceding, viewed in the rotational direction of the impeller, the gas discharge opening 20 in the impeller 5, substantially extend from the bottom edge of gas discharge openings 20, i.e. the edge or part closest to the shaft, to the outer periphery of impeller 5. It is, however, understood that the dimensions of said vanes 31, 32 may deviate even to a considerable extent, from those of the above described preferred embodiment without deviating from the inventive concept and the operational characteristics described below.

FIG. 5 illustrates how the pulp accumulated in the spaces 33–38 between each of the vanes 31, 32 and spaces 39–44 between each pair of vanes 31, 32 of the impeller 5 behaves differently in relation to the effect which the contour of the pump housing 15 has on the pulp within the respective space. The pulp in the spaces 33–36 at the front side of the fully long vane 31 acts as already described above. In other words, in spaces 33–38 the boundary surface between the pulp and the gas forms a serrate or wavy shape so that the pulp contacting the front surface of the fully long vane 31 is pushed closer to the shaft than the part of the pulp which is against the rear surface of the preceding shorter vane 32. However, the situation is different in the spaces 37 and 38, namely in those spaces, which are effected by the highest pressure of volute or housing contour 15. The high pressure will cause the pulp to flow towards the shaft. Accordingly, in those gaps 37, 38 the form of the boundary surface between the pulp and the gas is turning (space 37) to the opposite direction (space 38). This "reversal" of the boundary surface is explained by the fact that the pulp in space 37 has reached a certain circumferential speed which the pulp due to its inertia tends to maintain regardless of the fact that when the space moves into the zone of higher pressure, the higher pressure causes the pulp to move towards the center of the pump, whereby the circumferential speed of the impeller 5 relative to the speed of the pulp parallel to the impeller periphery decreases so that the pulp will accordingly accumulate against the rear surface of the shorter vane 32 which operates as the front edge in the space 38. Thus, the boundary surface between the gas bubble and the fiber suspension extends in space 38 of FIG. 5 already over gas discharge opening 20 of the impeller 5 and will gradually increase to pass the end of shorter vane 32, from where the flow, still due to its inertia, will flow into the preceding space 44, in which the centrifugal force will throw the pulp toward the outer periphery of the impeller. Housing contour 15 causes a lower pressure in the preceding space 44, because it has already moved past the high pressure zone.

The boundary surface between the pulp and the gas should also be noticed in spaces 39–44, in other words, in those spaces which have no gas discharge openings 20. In these spaces the shape of the interfaces remains at all times substantially parallel to the periphery of impeller 5, because the changes of the circumferential speed of the pulp in these spaces 39–44 are minor and because the radial shifts of the pulp in these spaces are also relatively small.

Figure 6:
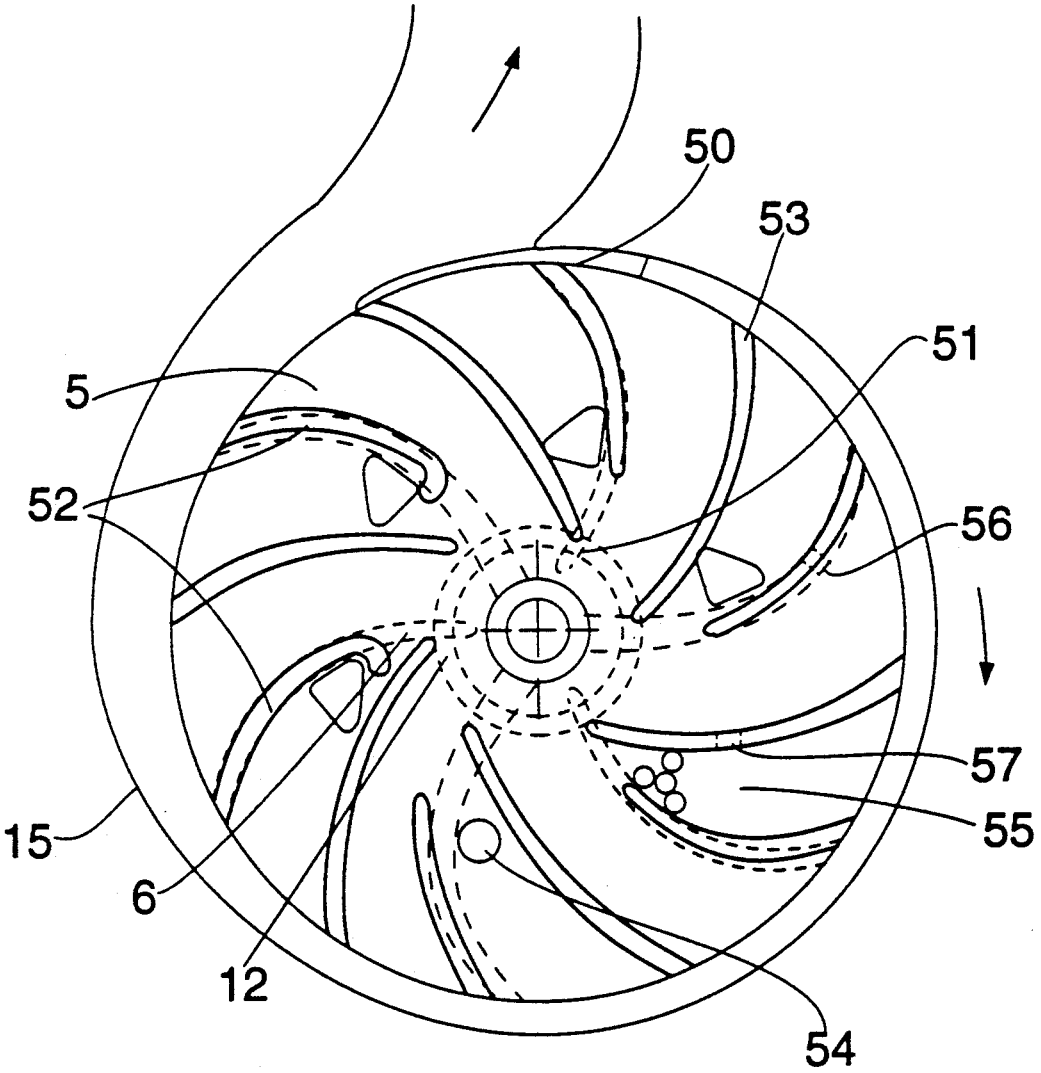
FIG. 6 is a schematic view of yet other embodiments of the present invention combined together in one drawing viewed from the back side of the impeller.

A number of other embodiments are shown in FIG. 6, which may be used either together or separately. The pressure effects of housing contour 15 may be eliminated, both by substantially sealing the outer periphery of impeller 5, for example, by making the clearance between impeller 5 and the pump housing with a closing element 50 so small that the pressure due to the housing contour 15 would not disadvantageously effect the back side of the impeller 5, when the pressure is otherwise at its highest, and by making the clearance between the rear wall of the pump and the shaft with a similar closing element 51 so small that the radial flow of the pulp decelerates in the space between vanes at the pressure peak when the vanes are, for example, as shown in FIG. 3. Furthermore, the rear vanes of impeller 5 may be designed in such a way that due to said pressure the movement of the radially inwardly moving pulp is prevented, for example, by shaping the lower end of the shorter vanes 52 to follow the form of opening 20 of impeller 5, whereby the pulp flowing along the rear surface of vane 52 towards the pump center is forced through opening 20 toward the front side of impeller 5 and the gas is discharged through the clearance between the shorter and the longer vane towards the gas discharge opening 12 in the rear wall of the pump. In the last mentioned embodiment it is, of course, not necessary that the vanes are of different length or that there are two vanes for each pumping vane 6, as long as the inner or lower end of each rear vane is shaped in the described way. Further, rear vanes may be formed even slightly shorter than described above so that when the fiber suspension moves towards gas discharge opening 12, it will flow on towards the next space between vanes without the risk of the pulp escaping through the discharge opening in the rear wall of the pump.

FIG. 6 also illustrates other alternatives for the gas discharge openings of the impeller. Thus, the openings may form either individual round apertures 54 or a group of perforations 55 or even a greater number of perforations, thereby forming substantially a filter surface as the gas discharge opening.

Further, a gas discharge opening 56, for example, may be provided at each vane located in the rotational direction in front of a space between vanes having an opening therein through which discharge opening the pulp may be discharged to the preceding vane gap. The discharge opening may also be an aperture 56, or a slot in the respective vane, or a bevel in the area of one end of the vane, or it may be an opening between the vane and the rear plate of the impeller or it may also be an actual gap in the vane. Alternatively, a discharge cutout or even a flow duct may be arranged in the rear wall of the pump in the area of the rear vanes and further in the area in which the higher pressure of the pump housing contour influences the space between the vanes, in other words, between the center of the pump and the discharge opening. In the embodiments described the pressure of the pump housing contour is directed to the spaces between vanes adjacent thereto or even to a more distant space between vanes (through the duct in the rear wall of the pump), which space is in the area of lower pressure, or if the entire pressure field of the pump housing is considered, in the area of the lowest pressure. Flow passages 57 can be provided in communication with an adjacent vane 53, in other words, the vane further behind relative to the rotational direction of the impeller. This vane also limits the space between it and the adjacent vane, whereby the pressure will be discharged in a corresponding way to the space next to it, but the operational concept of this embodiment is not as elegant as the above-described solution.

In addition, a number of alternative embodiments may be mentioned which are not shown in the drawings. Firstly, as mentioned already above, the clearance between the impeller and the pump housing can be arranged small or narrow in the area of the rear vanes in such a way that the curved plate 50 shown in FIG. 6 extends to cover substantially the entire length of the periphery whereby the rear vanes of the impeller are made to rotate within their own "ring", wherein openings or perforations have been provided for the discharge of the material accumulated in the spaces between the vanes to the space between the periphery of the impeller and the housing of the pump. When these perforations are mainly positioned in the lower pressure area of the pump housing, the generated pressure is unable to effect the pulp in the spaces between the vanes.

Alternatively, the effect of the pressure of the pump housing may be diminished by decreasing the time which the force component created by said pressure and which is directed toward the pump center requires to accelerate the pump present in the spaces between the vanes or by increasing the distance the medium must travel to reach the gas discharge duct. This may be achieved as mentioned above by increasing the number of vanes. Alternatively, the lower end of the vanes or the lower end of at least one of the vanes limiting each space provided with a gas discharge opening can be bent towards the other said vane limiting said space in such a way that the area of the space which is open and parallel to the periphery of the impeller diminishes, whereby the time during which the above-mentioned force component is effective naturally decreases. The bending of the vane/vanes is achieved, for example, in such a way that the top part of the vane is extended parallel to the periphery towards another vane or that the vane as a whole is bent more towards another adjacent vane. Thereby, the component directed towards the shaft and caused by the pressure of the pump housing creates a radial force directly affecting the impeller. It is, of course, also possible that the vanes are arranged, for example, in such a way that every other vane extends radially while the remainder of the vanes are bent backwards as discussed, whereby the space between the vanes remains either equally wide in the direction of the periphery or the space becomes narrower in the outward direction. Further, it is possible to arrange one or more local constriction points between the rear vanes or to arrange the rear vanes in a wavy form in such a way that the distance which the flow travels from the outer periphery of the impeller to the gas discharge duct is extended, whereby the decelerating effect which the frictional forces have on the movement of the pulp is also increased.

FIGS. *7a* and *b* illustrates the forces effecting each pulp particle which has flown to the back side of the impeller through the gas discharge opening therein. FIG. *7a* illustrates the situation in which the pulp particle has just flown through impeller opening to the back side thereof, in other words, the situation in which the centrifugal force mainly determines the motional direction of the pulp particle which is towards the periphery of the impeller. FIG. *7b* illustrates the situation in which the pulp particle is subjected to an intensive radial force from the direction of the periphery so that the particle moves towards the center of the impeller. In the figures different forces are referred to in the following way:

Fc=centrifugal force; Fi=inertial force; Fsp=radial force, which is due to the pressure of the pump housing; Fb=force directed to the pulp particle from the rear vane. Additionally, the sub-indexes r and c refer to the radial component and the component parallel to the periphery, respectively. Although the direction of the resultant R of these forces has been sketched into the drawings, it is understood that the resultant may in reality deviate even considerably in size and in direction from the one shown.

According to FIG. *7a*, in a centrifugal pump, to which the arrangement in accordance with the present invention may be applied, the pulp particle is subjected to a centrifugal force directed away from the shaft and to a force, which is due to the pressure of the volute of the pump directed toward the shaft, but which force is, however, less intensive than the centrifugal force. In addition, the particle is affected by inertial force which, due to the combined effect of said radial forces has the direction shown in the figure, in other words, will act to decelerate the movement of the pulp particle relative to the impeller.

Furthermore, the pulp particle is subjected to a force component, directed both radially and one parallel to the periphery, by the rear vane of the impeller, in this case, the rear vane being inclined, whereby the resultant R of the forces directed to the pulp particle has the direction of the tangent of the vanes of the impeller.

Figure 7A:
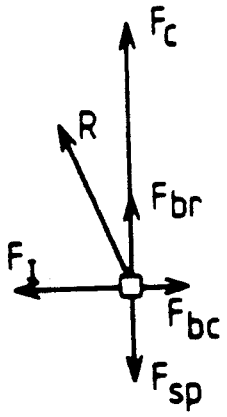
FIGS. 7*a* and 7*b* are diagrams representing the forces affecting each pulp particle behind the impeller.
Figure 7B:
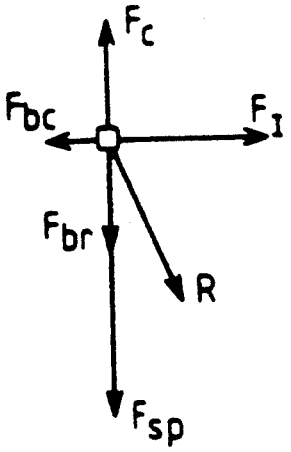

In FIG. *7b* the pulp particle is subjected to a powerful force directed towards the shaft, which is due to the pressure of the volute or pump housing contour in such a way that the force even supersedes the centrifugal force. Thereby, the inertial force tends to carry the pulp particle faster than the impeller in the direction following the periphery which effect is resisted by the rear surface of the rear vane in such a way that the direction of the resultant of all forces is parallel to the tangent of the rear vane. This figure especially clearly indicates what happens when the force directed to the pulp particle present at the rear vane seizes. In this case, the effect of the force directed toward the shaft diminishes and the effect of the force parallel to the periphery of the impeller increases, whereby the direction of the pulp particle changes to approach the direction of the tangent of the periphery of the impeller. In other words, if the effect of the rear vanes ceases prior to the central gas discharge opening of the rear wall of the pump, the direction of the pulp particle changes around the end of the vane, whereby the pulp particle is forced to the previous space between vanes, in which, on the other hand, the pressure effect of the volute is the weakest and, on the other hand, the effect described in FIG. 7 is the highest.

As is noted in the above description, a great number of arrangement have been developed, by which it is possible to reliably prevent the fiber suspension from flowing to the gas discharge system and into the vacuum pump. In the known devices it has been necessary for the above-mentioned reasons to operate the vacuum pump by a separate actuator, an apparatus outside the pump. However, the present invention has now enabled the use of a vacuum pump in connection with the pumping of fiber suspensions, an example being a so-called liquid ring pump which can be used directly with the pump by the same actuator. In other words, a vacuum pump may be arranged on the same shaft inside the housing of the centrifugal pump without the risk of clogging the vacuum pump 16 (FIG. 8*a*).

Figure 9:
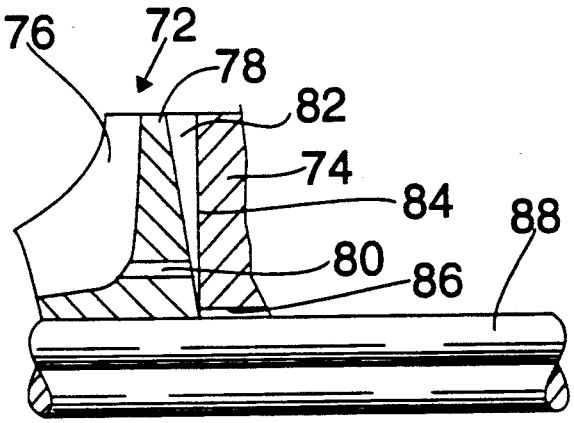
FIGS. 9, 10 and 11 illustrate some preferred arrangements with regard to the direction and shape of the impeller back plate and the back wall of the pump.

In FIG. 9 a centrifugal pump impeller 72 and a pump back wall 74 are shown schematically. The pump impeller comprises pumping vanes 76, a so-called back plate 78, gas discharge openings 80 in said back plate 78 and back vanes 82 arranged on the back side of said impeller back plate 78. The back wall 74 of the pump is shown only partially, as only the surface 84 and the gas discharge channel 86 are important for a proper understanding of the invention. The discharge channel 86 is preferably arranged annularly round the shaft 88, as shown in FIG. 9. However, the channel may also be in the form of a non-annular opening in connection with the opening for the shaft or it may also be a separate opening through the back wall 74. It is essential for the embodiments shown in FIGS. 9, 10 and 11 that the space between the impeller back plate 78 and the back wall 74 of the pump is radially outwardly widening in order to facilitate the liquid/suspension flow outwards i.e. the discharge thereof and prevent such flow towards the shaft, thereby eliminating the blocking of the spaces between the back vanes by the fiber suspension as efficiently as possible. In FIG. 9 both the impeller back plate 78 and the back wall 74 are inclined such that said space is outwardly widening, i.e. the back plate is inclined forward (towards the inlet channel of the pump) and the back plate backward (towards the drive end of the pump). It is to be noted that the back vanes 82 may be either fixed to the impeller back plate 78 or arranged as a separate vaned rotor at the back side of the impeller back late. In any case the operation of the back vanes is in either of the cases substantially the same.

Figure 10:
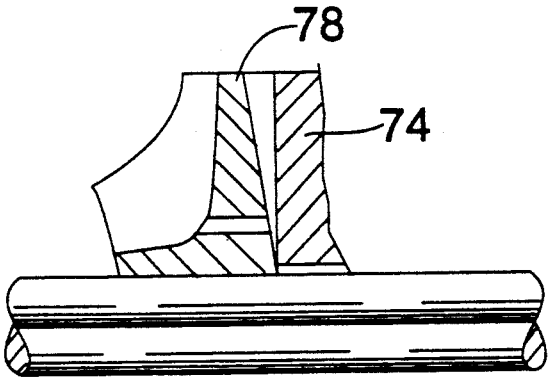

FIG. 10 illustrates another embodiment where only the back wall 74 of the pump is inclined backwards, the back plate 78 being radial or perpendicularly to the axis of the pump or the pump shaft. It is also possible that both the back plate and the back wall are inclined backwardly, but the back wall being inclined more such that the space therebetween is still widening. Also it is possible that only the back plate is forwardly inclined the back wall being radial or that both are forwardly inclined. It is also to be noted that neither the back plate back surface nor the surface of the back wall need to be as flat (as shown in the drawings) they may also be curved, convex or concave.

Figure 11:
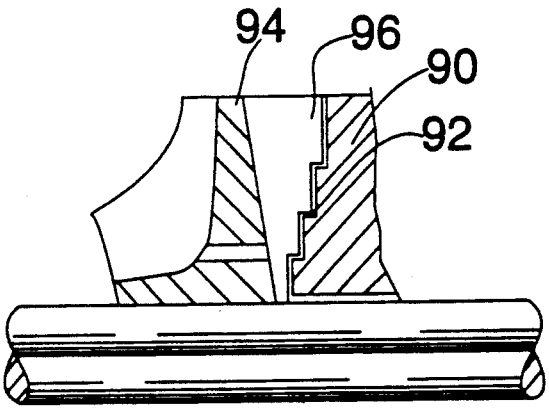

FIG. 11 shows yet another embodiment where the back wall 90 of the pump is provided with steps 92 in such a way that the space between the back plate 94 and the back wall 90 widens stepwise in radial direction. Naturally, the back vanes 96 have corresponding steps or shoulders so that an excess leakage between the vanes and the back wall is prevented. It is also be possible to arrange corresponding steps in the back plate of of the impeller, whereby the back wall of the pump may be either radial, inclined or provided with similar steps.

It should be noticed that the different back vane structures described in connection with FIGS. 1–8 as well as all structures covered by the claims may be used in connection with the back wall/back plate configurations described in FIGS. 9–11.

Finally, it should be born in mind that the above description is only illustrative of a number of embodiments of a pump arrangement in accordance with the present invention. The scope of the invention is, however, not restricted to the above-described most advantageous constructional solutions, the purpose of which is merely to show exemplary different alternatives for the realization of the present invention. Thus, the scope of the invention is restricted only by what is set forth in the accompanying claims. It should also be understood that included in the present invention are all arrangements in which the increase of the acceleration of pulp towards the center of the pump or more exactly towards the gas discharge opening in the rear wall of the pump caused by the force components directed towards the center of the pump due to the pressure changes of the volute or pump housing to a level at which pulp is discharged to the gas discharge system is prevented.

Additionally, it should be noted that the method and apparatus in accordance with the present invention may be applied to all pumps and respective apparatus in which gas is discharged during the treatment of gas containing medium therein.

It should be understood that the preferred embodiments and examples described are for illustrative purposes only and are not to be construed as limiting the scope of the present invention which is properly delineated only in the appended claims.

What is claimed is:

1. An apparatus for separating gas from a medium being pumped by a pump comprising:

a pump housing having a suction inlet and discharge opening, an a impeller comprising a back plate having a front face and a rear face and being mounted on a shaft for rotation about an axis of rotation within said housing and for pumping said medium from said suction opening to said discharge opening; a plurality of pumping vanes mounted on the front face of said impeller back plate; a plurality of gas discharge openings between said vanes and extending through said impeller back plate from said front face to said rear face thereof; a rear wall extending outwardly from said axis of rotation and forming with said rear face of said impeller back plate a radially outwardly widening space bounded by and defined between said rear wall and said rear face of said impeller back plate, said rear wall having adjacent said axis of rotation a gas discharge opening therein; and means comprising a plurality of rear vanes on said rear face of said impeller back plate for generating a combination of radial forces, forces directed parallel to the periphery of said impeller and inertial forces and for directing said flow of medium present at the rear of said impeller so as to prevent said flow from entering said gas discharge opening in said rear wall, said gas discharge openings in said back plate of said impeller, when viewed in a circumferential direction, being located between said rear vanes.

2. The apparatus in accordance with claim 1, wherein said means for directing said medium flow additionally comprises pump parts cooperating with said rear vanes and wherein said flow is prevented from entering said discharge opening by leading said flow of medium past said gas discharge opening.

3. The apparatus in accordance with claim 1, wherein said means for directing said medium flow additionally comprises pump parts cooperating with said rear vanes and wherein said flow is prevented from entering said discharge opening by dampening said flow of said medium between respective rear vanes.

4. The apparatus in accordance with claim 1, wherein said means for directing said medium flow directs said flow present in said space between said rear vanes substantially towards said shaft of said impeller and past said discharge opening in said rear wall essentially due to a pressure difference caused by said pump housing contour.

5. The apparatus in accordance with claim 1, wherein said means for directing said medium flow is arranged so that said flow of medium present in said space between said rear vanes which is substantially directed towards said shaft of said impeller caused by the pressure difference due to the pump housing contour, is dampened so that entry of said medium into said gas discharge opening is prevented thereby.

6. The apparatus in accordance with claim 1, wherein the number z of rear vanes of said impeller corresponds to the formula $z > 370 \times \sin \alpha / n$, wherein $\alpha$ represents the angle between the tangent of said impeller and the average direction of said rear vane and n represents the rotational speed of said impeller.

7. The apparatus in accordance with claim 1, wherein the number of rear vanes is at least twice the number of pumping vanes at the front side of said impeller, and wherein said gas discharge opening in said impeller is located, viewed from the back side of said impeller, at most in every second space between rear vanes.

8. The apparatus in accordance with claim 1, wherein at least one of said rear face of said impeller back plate and said back wall is inclined to form said radially outwardly widening space.

9. The apparatus in accordance with claim 1, wherein at least one of said rear face of said impeller back plate and said back wall is provided with steps to form said radially outwardly widening space.

10. The apparatus in accordance with claim 1, wherein said rear vane preceding said gas discharge opening in said impeller in the rotational direction of said impeller is shorter than said vane following said opening.

11. The apparatus in accordance with claim 1, additionally comprising a flow passage located in said rear vane of said impeller connecting adjacent spaces between vanes to each other.

12. The apparatus in accordance with claim 11, wherein said flow passage is a perforation.

13. The apparatus in accordance with claim 1, wherein said discharge opening in said impeller has a triangular shape and wherein said inner end of vane preceding said gas discharge opening of impeller in the rotational direction of said impeller follows the shape of the front and inner edge of said gas discharge opening.

14. The apparatus in accordance with claim 1, additionally comprising means for modifying the flow surface area parallel to the periphery of said impeller in the space between rear vanes of said impeller so that said flow surface area is either uniform throughout the entire radial length thereof, is radially outwardly narrowing, or throttled, said means comprising an extension parallel to the periphery of said impeller at the end of at least one of said rear vanes.

15. The apparatus of claim 14, wherein said means comprise inclined rear vanes.

16. The apparatus in accordance with claim 14, wherein said means comprise at least one throttling point in said space between said vanes.

17. The apparatus in accordance with claim 1, additionally comprising a closing element mounted at least between said pressure opening of said pump housing and said discharge opening in said rear wall, whereby said medium is prevented from flowing into said gas discharge system.

18. The apparatus in accordance with claim 17, wherein said closing element is mounted within the pump housing at a radial distance from said axis and outside said rear vanes of said impeller.

19. The apparatus in accordance with claim 17, wherein said closing element substantially surrounds said rear vanes of said impeller, and wherein said closing element has openings therein for permitting the discharge of medium towards said pump housing.

20. The apparatus in accordance with claim 17, wherein said closing element comprises a protrusion extending parallel to said discharge opening of said pump housing at the edge of said central gas discharge opening in said rear wall, said protrusion closing said gas discharge opening surrounding said shaft of said impeller for throttling the clearance between said rear wall and said shaft.

21. The apparatus in accordance with claim 1, additionally comprising a vacuum pump in communication with said gas discharge system.

22. The apparatus in accordance with claim 21, wherein said vacuum pump is mounted on the same shaft as said impeller.

23. The apparatus in accordance with claim 21, wherein said vacuum pump is actuated by a separate motor.

24. The apparatus in accordance with claim 1, additionally comprising fluidizing blades mounted on said shaft in front of said impeller.

25. The apparatus in accordance with claim 1, wherein at least one of said rear face of said impeller back plate and said back wall is curved to form said radially outwardly widening space.

26. The apparatus in accordance with claim 1, wherein the number of said back vanes exceeds the number of the pumping vanes.

27. An apparatus for separating gas from a medium being pumped by a pump comprising:

a pump housing having a suction inlet and discharge opening therein; an a impeller comprising a back plate with a front and a rear face and being mounted on a shaft for rotation about an axis of rotation within said housing and for pumping said medium from said suction opening to said discharge opening; a plurality of pumping vanes mounted on the front face of said impeller back plate; a plurality of gas discharge openings extending through said impeller back plate from said front face to said rear face thereof; a rear wall extending outwardly from said axis of rotation and defining a radially outwardly widening space between said rear wall and said rear face of said impeller back plate and having adjacent said axis of rotation a gas discharge opening therein, and means comprising a plurality of radially inclined rear vanes for generating a combination of radial forces, forces directed parallel to the periphery of said impeller and inertial forces and for directing said flow of medium present at the rear of said impeller so as to prevent said flow from entering said gas discharge opening in said rear wall, said discharge openings in said impeller back plate, when viewed in a circumferential direction, being located between said rear vanes.

28. The apparatus in accordance with claim 27, wherein said rear vanes are inclined from the outer periphery of said impeller substantially backwards relative to the rotational direction of said impeller in such a way that the imaginary extension of said rear vanes towards said discharge opening substantially coincides with the tangent at said gas discharge opening in said rear wall.

29. The apparatus in accordance with claim 27, additionally comprising fluidizing blades mounted on said shaft in front of said impeller.

30. The apparatus in accordance with claim 27, wherein at least one of said rear face of said impeller back plate and said back wall is inclined to form said radially outwardly widening space.

31. The apparatus in accordance with claim 27, wherein at least one of said rear face of said impeller back plate and said back wall is provided with steps to form said radially outwardly widening space.

32. The apparatus in accordance with claim 27, wherein at least one of said rear face of said impeller back plate and said back wall is curved to form said radially outwardly widening space.

33. The apparatus in accordance with claim 27, wherein the number of said back vanes exceeds the number of the pumping vanes.

* * * * *